US008408287B2

(12) United States Patent
Wittle et al.

(10) Patent No.: US 8,408,287 B2
(45) Date of Patent: Apr. 2, 2013

(54) ELECTRICAL JUMPER FOR A PRODUCING OIL WELL

(75) Inventors: J. Kenneth Wittle, Williamsburg, VA (US); James Harrison, Duluth, MN (US)

(73) Assignee: Electro-Petroleum, Inc., Wayne, PA (US)

( * ) Notice: Subject to any disclaimer, the term of this patent is extended or adjusted under 35 U.S.C. 154(b) by 355 days.

(21) Appl. No.: 12/792,815

(22) Filed: Jun. 3, 2010

(65) Prior Publication Data

US 2011/0297366 A1 Dec. 8, 2011

(51) Int. Cl.
*E21B 17/10* (2006.01)
*E21B 43/24* (2006.01)
*H01R 4/60* (2006.01)

(52) U.S. Cl. ..... 166/65.1; 439/192; 166/248

(58) Field of Classification Search ..... 166/248, 166/65.1, 172, 241.1, 241.6, 241.7, 157, 166/60, 277, 67, 213, 114, 302, 122, 250.17, 166/222, 144, 278, 51, 382, 380, 378, 254.2, 166/286, 250.1, 301, 383, 205, 59, 367, 61, 166/141; 439/190–206, 210, 507–514, 63
See application file for complete search history.

(56) References Cited

U.S. PATENT DOCUMENTS 1,773,398 A * 8/1930 La Velle ..... 166/241.6
2,220,237 A * 11/1940 Hall ..... 166/172
2,387,493 A * 10/1945 Brokaw ..... 166/141
2,555,628 A * 6/1951 Baker ..... 166/241.6
2,562,083 A * 7/1951 Clark, Jr. ..... 166/241.6
2,832,421 A * 4/1958 Baker ..... 166/213
2,841,226 A * 7/1958 Conrad et al. ..... 166/213
2,997,108 A * 8/1961 Sievers et al. ..... 166/222
3,000,444 A * 9/1961 Wright et al. ..... 166/241.7
3,044,554 A * 7/1962 Kluck ..... 166/241.6
3,124,196 A * 3/1964 Solum ..... 166/241.6
3,149,676 A * 9/1964 Ensminger ..... 166/67
3,270,697 A * 9/1966 Solum ..... 228/144
3,312,285 A * 4/1967 Solum ..... 166/241.6
3,437,142 A * 4/1969 Conover ..... 166/277
3,542,127 A * 11/1970 Malone ..... 166/122
3,572,432 A * 3/1971 Aulick ..... 66/114
3,977,468 A 8/1976 Brewer et al.
4,088,186 A * 5/1978 Callihan et al. ..... 166/241.7
4,363,360 A * 12/1982 Richey ..... 166/241.7
4,651,823 A * 3/1987 Spikes ..... 166/241.7
5,033,549 A * 7/1991 Champeaux et al. ..... 166/278
(Continued)

*Primary Examiner* — Shane Bomar
*Assistant Examiner* — Wei Wang
(74) *Attorney, Agent, or Firm* — Dann Dorfman Herrell & Skillman; Henry H. Skillman

(57) ABSTRACT

A jumper providing electrical communication between two components of a producing well of an oil field. The jumper has two tubings for insertion in two components each with an anchor adapted to be rigidly mounted in its associated component. Each tubing has a centering device, consisting of a pair of rings surrounding the tubing and an array of bowed springs bridging between the rings and biased to bow outwardly into engagement with the bore of the associated component. One of the two rings is electrically and mechanically connected to the tubing, whereas the other ring is free to be displaced longitudinally of the tubing so that the outer diameter of the array of bowed el springs may expand or contract, as needed. Each bowed spring in the array is provided with supplemental electrical contacts to insure a path of electrical conductivity between the connected ring and the associated component through the bowed springs.

11 Claims, 4 Drawing Sheets

U.S. PATENT DOCUMENTS 5,115,860 A * 5/1992 Champeaux et al. ..... 166/51
H001192 H * 6/1993 Keller ..... 166/241.6
5,261,488 A * 11/1993 Gullet et al. ..... 166/241.7
5,339,898 A * 8/1994 Yu et al. ..... 166/248
5,377,750 A * 1/1995 Arterbury et al. ..... 166/205
5,641,018 A * 6/1997 King ..... 166/172
6,478,086 B1 * 11/2002 Hansen ..... 166/250.17
6,484,803 B1 * 11/2002 Gremillion ..... 166/241.6
6,533,034 B1 * 3/2003 Barger ..... 166/241.7
6,715,550 B2 * 4/2004 Vinegar et al. ..... 166/250.15
7,032,658 B2 * 4/2006 Chitwood et al. ..... 166/61
7,311,151 B2 * 12/2007 Chitwood et al. ..... 166/367
7,325,604 B2 * 2/2008 Wittle et al. ..... 166/248
7,360,588 B2 * 4/2008 Vinegar et al. ..... 166/59
7,673,682 B2 * 3/2010 Daily ..... 166/254.2
7,708,064 B2 * 5/2010 Sehsah ..... 166/241.6
7,831,133 B2 * 11/2010 Vinegar et al. ..... 392/301
8,224,165 B2 * 7/2012 Vinegar et al. ..... 392/301
2002/0053436 A1 * 5/2002 Vinegar et al. ..... 166/302
2002/0112853 A1 * 8/2002 Buytaert ..... 166/241.6
2002/0139533 A1 * 10/2002 Cox ..... 166/302
2002/0139537 A1 * 10/2002 Young et al. ..... 166/378
2002/0139538 A1 * 10/2002 Young et al. ..... 166/380
2003/0070803 A1 * 4/2003 Gremillion ..... 166/241.6
2003/0150614 A1 * 8/2003 Brown et al. ..... 166/286
2004/0149434 A1 * 8/2004 Frey et al. ..... 166/250.1
2007/0133961 A1 * 6/2007 Fairbanks et al. ..... 392/301
2009/0166027 A1 * 7/2009 Sehsah ..... 166/241.6
2010/0084144 A1 * 4/2010 Vaeth et al. ..... 166/383
2010/0252279 A1 * 10/2010 Buytaert et al. ..... 166/382
2011/0042102 A1 * 2/2011 Buytaert ..... 166/380
2011/0088904 A1 * 4/2011 de Rouffignac et al. ..... 166/302
2012/0186808 A1 * 7/2012 Lively et al. ..... 166/241.6

* cited by examiner

ELECTRICAL JUMPER FOR A PRODUCING OIL WELL

FIELD OF INVENTION

The present invention relates to apparatus for enhancing the production of oil from subterranean oil reservoirs with the aid of electric current and, in particular, apparatus for enhancing the performance of the method described in U.S. Pat. No. 7,325,604, issued Feb. 5, 2008, the entire contents of which are incorporated herein by reference.

BACKGROUND OF THE INVENTION

As set forth in more detail in U.S. Pat. No. 7,325,604, the oil producing well is completed by drilling a downhole into the oil-bearing formation and providing intercommunicating conduit sections to provide a casing and/or a liner for the removal of oil. The liner is foraminous in order to permit the oil to enter the conduit sections throughout the length of the foraminous liner. It has been found that the production of oil is enhanced by connecting a negative electrode to the liner and introducing a second electrode in proximity to the formation. A voltage difference is established between the first and second electrodes to create an electric field across the formation. As shown in the patent, the downhole is drilled and the liner is installed and is connected to a casing which is anchored at the surface above the formation. At its lower end, the casing is connected to the proximal end of the liner and is operatively connected to the bore of the liner. The casing mounts a pump for the extraction of the oil produced by the well. The casing and the liners are formed by a series of interconnected conduit sections which have joints along their lengths between the proximal and distal ends of the drilling hole. The conduit sections are electrically conductive to provide a path of electrical conductivity along the length of the assembled conduit sections. It has been found that the joints between the conduit sections sometimes separate or deteriorate to a point where the impaired joints produce an impedance in the path of electrical conductivity, resulting in substantial loss of voltage between adjacent conduit sections, and a possibility of leakage between the conduit sections of the casing or liner and the surrounding underground formation.

SUMMARY OF THE INVENTION

The present invention provides an electrical jumper for bridging the impaired joints between the adjacent aligned conduit sections to insure an unimpeded path of electrical conductivity between the conduit sections, reducing the loss of voltage which may occur when the joints deteriorate, and/or when the joints do not otherwise provide adequate electrical conductivity between the adjacent sections.

More specifically, the present invention provides a jumper composed of interconnected tubings adapted to be centered in the adjacent conduit sections on either side of the joint.

The tubings have a central bore which permits the flow of oil from the downhole into the casing where it is withdrawn by the conventional pump which is mounted at the bottom of the casing. The oil is pumped to the surface by the pump through piping.

In accordance with the invention, centering devices are provided about the outer perimeter of the tubings to center the same within the bores of the conduit sections or liners, the centering devices including means to provide a path of electrical conductivity between the conduit section or liner and the enclosed tubing.

In a preferred embodiment of the invention, the centering device includes a pair of rings encircling the tubing. The rings are connected by an array of bowed springs spaced circumferentially about the rings. Each bowed spring bows outwardly between the rings to resiliently bear against the interior bore of the conduit section in which it is mounted. Each ring encircles the outer circumference of the tubing, one of the rings being anchored to the tubing and the other of the rings being free to be displaced longitudinally of the tubing to allow radial expansion and contraction of the bowed springs.

The invention may also insure enhanced electrical conductivity by providing electrical contacts on the bowed springs where they bear against the internal bore of the associated conduit section to enhance the electrical conductivity between the bowed spring and the ring which is electrically connected to the tubing, for example by welding.

The jumper may be modified to reduce oil leakage through the joint between the interiors of the conduit sections and the surrounding underground formation.

BRIEF DESCRIPTION OF THE DRAWINGS

The invention will be described in greater detail with reference to the accompanying drawings in which.

DESCRIPTION OF THE PREFERRED EMBODIMENTS

Figure 2:
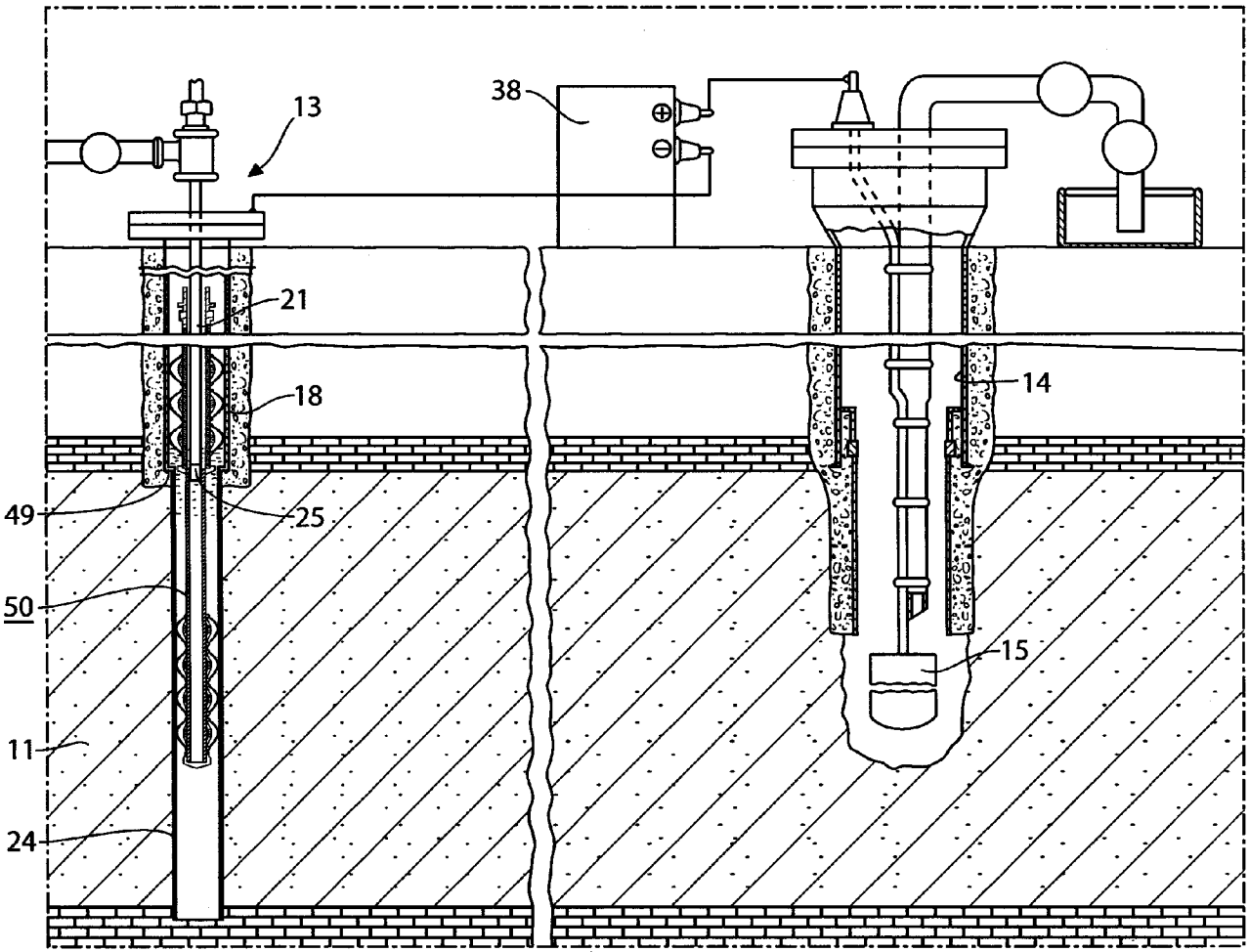
FIG. 2 is a diagrammatic view of a producing well having an upper casing and a lower liner vertically aligned, with a jumper according to FIG. 1 installed between the casing and the liner to provide an unimpeded path of electrical conductivity therebetween.

Referring to FIG. 2, the drawing illustrates an oil producing well 13 of the type shown in U.S. Pat. No. 7,325,604. The well 13 has a bore hole penetrating the oil-bearing formation 11 having a foraminous liner 24 which is connected to a casing 18 extending from the surface to the top of the formation 11 by a connecting joint at 49. The liner and casing are metallic and are connected to the negative terminal of an electric voltage source 38. A second bore hole 14 penetrates the oil formation 11 and encloses an electrode 15 which is connected to the positive terminal of the voltage source 38. As set forth in the above patent, the voltage source supplies an electric signal which has been found to enhance the production of oil from the formation 11. A pump 25 is mounted in the casing and has piping 21 for discharging the oil accumulating at the bottom of the casing 18. The casing and the liner constitute conduit sections which are effective to conduct oil from the oil-bearing formation into the casing where it is extracted by the pump 25.

Figure 1:
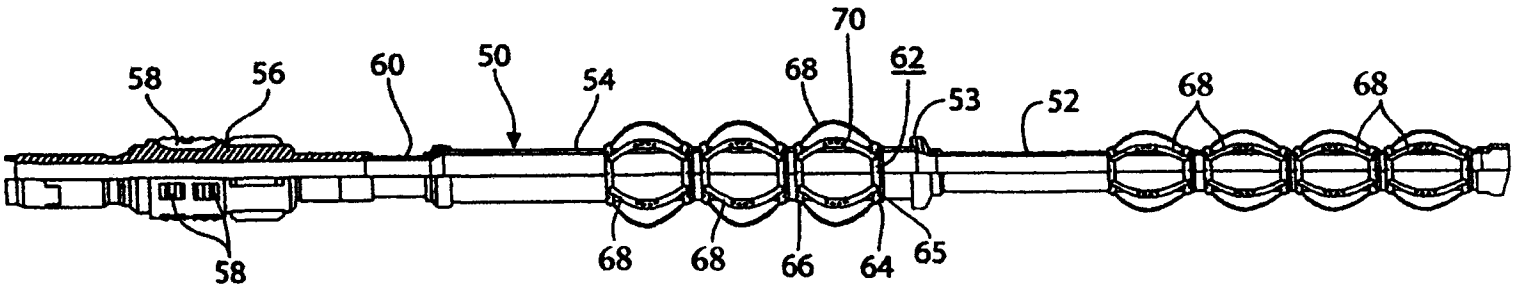
FIG. 1 is a side elevation of an electrical jumper embodying the present invention with an upper quadrant of the jumper broken away.

In accordance with the invention, it has been found that the electrical conductivity between the liner and the casing or the electrical conductivity across a joint between casing conduit sections may be impaired, and it is desirable to provide a jumper which may be inserted between the liner and the casing, and/or across an impaired joint, to assure electrical continuity between the liner and the casing or across the impaired joint between casing conduit sections. To this end, as shown in FIG. 1, a jumper 50 has a first tubing 52 which is hollow and is designed to fit within the distal conduit section shown in FIG. 2, in the present instance within the distal conduit section 24 and a second tubing 54 designed to fit within the proximal conduit section provided by the casing The tubings 52 and 54 are interconnected by a joint or fitting 53 and are adapted to be anchored into the well by an anchor 56 which has a series of jaws 58 which are operable to be displaced radially outward to firmly anchor the jumper within the bore hole. Preferably, the anchor has at least three jaws equally spaced about its perimeter so as to firmly anchor the jumper into the casing. The anchor 56 is connected to the tubings 52 and 54 by a fiberglass pup joint 60 of fiberglass or other insulating material which electrically isolates the anchor 56 from the interconnected tubings 52 and 54. In the present instance, as shown in FIG. 2, the tubings are centered within their respective conduit sections by bowed leaf springs 68 in centering devices 62 to provide a narrow annular space surrounding each tubing.

As shown encircling the tubing 54 in FIG. 1, each centering device 60 comprises a pair of rings 64 and 66 encircling the tubing. One of the rings 64 is electrically and mechanically connected to the tubing 54, for example by a weld joint 65, whereas the opposite ring 66 is slidable on the underlying tubing. The two rings 64 and 66 are interconnected by leaf springs 68 which span between the rings and are bowed outwardly to engage the interior wall of the surrounding conduit section. The bowed leaf springs are arranged in a circular array about the entire circumference of the centering device 62 and are biased outwardly into firm engagement with the interior wall of the surrounding conduit section. The displaceable ring 66 may be displaced longitudinally of the tubing to increase or decrease the projection of the outer perimeter of the array of bowed springs 68, as required by their engagement with the interior surface of the conduit section. To ensure electrical contact between the springs and the tubing, the medial portions of the leaf spring 68 are provided with supplemental electrical contacts 70 which assure electrical contact between the springs and the surrounding conduit section. The electrical path between the supplemental contacts 70 and the connected ring 64 is through the spring itself, but if desired, an additional electrical path may be provided to assure electrical conductivity from the conduit section through the contact to the ring 64 and the underlying tubing. It has been found desirable to design the jumper so that the bores of the tubings are between 40-55% of the bore of the associated conduit section, leaving room for the centering devices in the annular space surrounding the liners.

Figure 3:
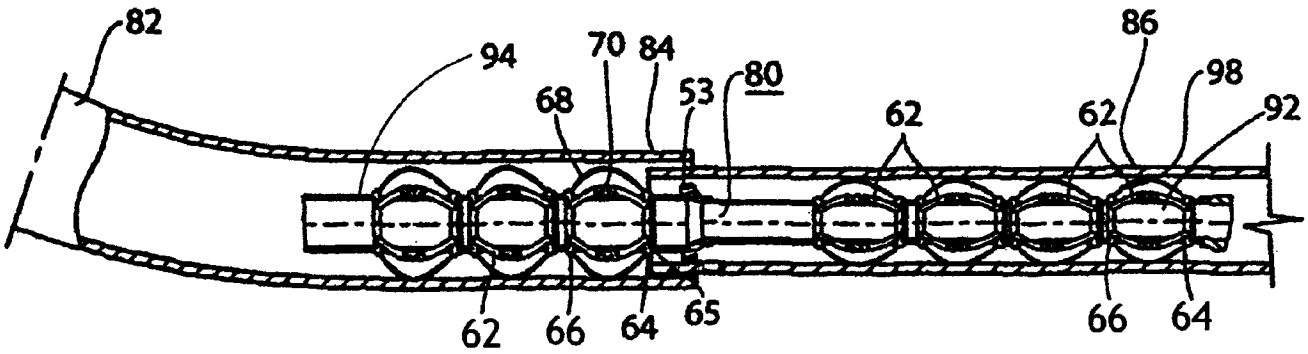
FIG. 3 is a fragmentary view of a producing well installation having a horizontal liner telescopically inserted into the horizontal end of a casing with a jumper having portions respectively inserted into the casing and the liner to establish an unimpeded path of electrical conductivity therebetween (for the purposes of illustration the clearance between the components of the impaired joint has been exaggerated)
Figure 4:
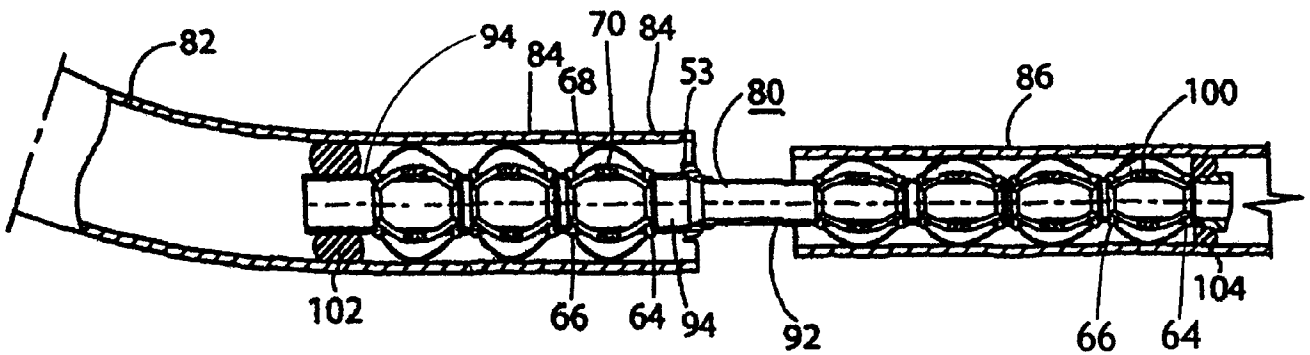
FIG. 4 is a fragmentary view of a producing well installation similar to FIG. 3 wherein the telescopic joint is impaired by dislodgment of the horizontal liner to a position adjacent the horizontal end of a casing with the jumper shown in FIG. 3 having portions respectively inserted into the casing and the liner to establish an unimpeded path of electrical conductivity therebetween and with plugs surrounding the opposite ends of the jumper to reduce leakage through the joint between a casing and a liner (for the purposes of illustration, the spacing between the components of the impaired joint has been exaggerated)
Figure 5:
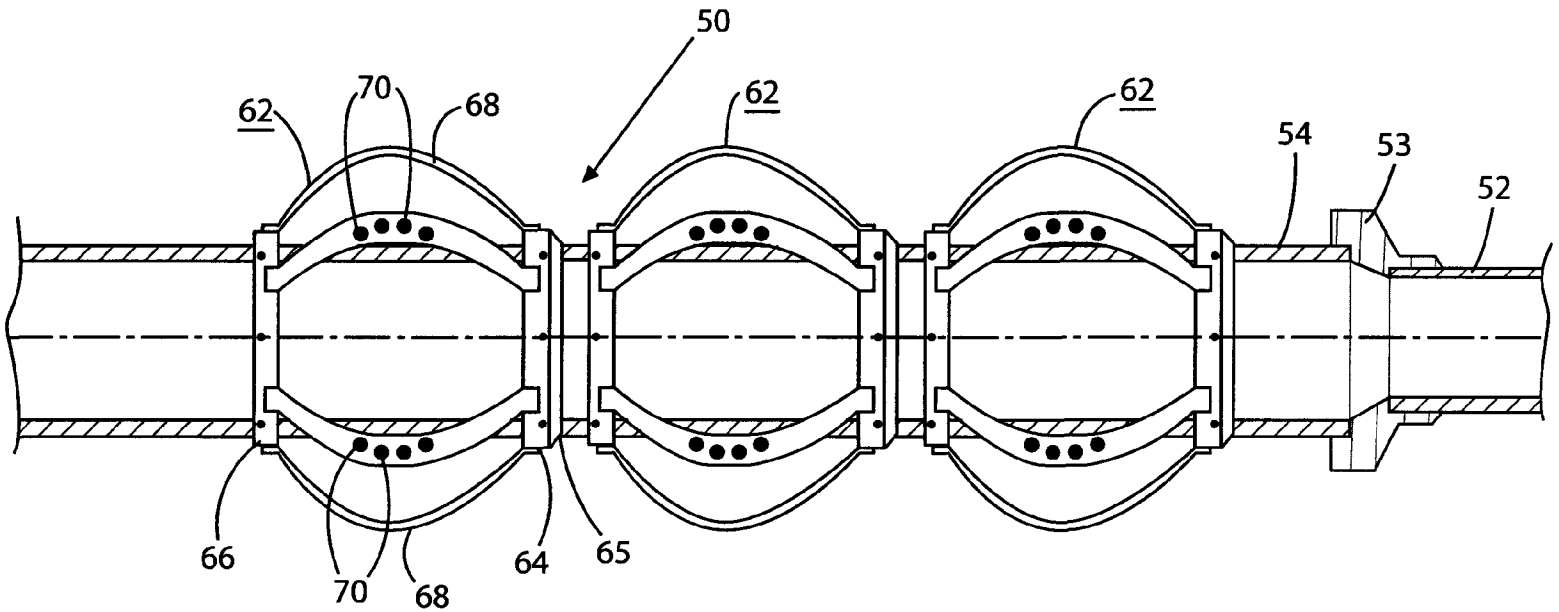
FIG. 5 is an enlarged fragmentary jumper of FIG. 3 which is mounted inside the casing showing its connection to the adjoining distal tubing portion of the jumper which is mounted inside the liner (the tubing being shown in section).

FIGS. 3 and 4 show two installations using a modified jumper 80 inserted between a well casing and horizontal liners of the downhole. In the present instance, the well casing 82 terminates in a horizontal extension 84 which is adapted to be joined with the proximal end of a liner 86 of the downhole. As shown in FIG. 3, the liner 86 telescopically engages the open end of the extension 84, illustrating a clearance which may impair the joint, whereas in FIG. 4, the joint is impaired because the liner 86 is separated from the extension 84. In each case, the jumper 80 is provided to provide an unimpeded path of electrical conductivity between the casing 82 and the liner 86.

With reference to the installation shown in FIG. 4, when the jumper is used to bridge the gap in the series of adjacent aligned conduit sections which are spaced apart, it may be desirable to insert an annular plug 102 between the extension 84 and the tubing 94 to close off the annular space between these components. Similarly, the annular space between the liner 86 and the tubing 92 may be plugged by an annular plug 104 to reduce leakage which would otherwise occur as a result of the gap. In this case, the jumper 80 not only provides electrical conductivity between the separated conduit sections, but also prevents leakage between the annular space within the conduit sections and the underground formation surrounding the gap. The plugs are annular rings of nitrile or other elastomeric material which is resistant to the fluids carried by the conduit sections.

The overall length of the jumper 80 shown in FIGS. 3 and 4 is shorter than the jumper 50 shown in FIG. 1, so that the jumper 80 will pass through the curvature between the extension 84 and the upper end of the casing at the surface. The casing follows an arcuate path from the surface to the extension 84 and the length of the jumper is tailored to pass along the arcuate path without jamming. In other respects, the jumper 80 is similar to the jumper 50 having distal and proximal tubings 92 and 94 interconnected by a joint or fitting 53. The tubings 92 and 94 have centering devices comprising fixed rings 64 and slidable rings interconnected by bowed springs 68 disposed in a circular array between the rings 64 and 66. The bowed springs 68 are provided with electrical contacts 70 and 100 similar to the contacts 70 described in connection with FIG. 1. The contacts are designed to provide electrical continuity between the liners 84 and 86 and the fixed rings 64 of the centering devices.

Preferably, each embodiment of the invention is designed to complement the conduit sections into which the jumper is installed. Preferably, each tubing has a bore which is between 40-55% of the bore of the associated conduit section to provide an annular space surrounding the tubings. In the installations of FIGS. 3 and 4, the fitting between the proximal and distal tubings has an outer diameter smaller than the bore of the conduit sections 84 and 86 surrounding the conduit section so as to allow limited flow between the annular spaces surrounding the distal and proximal tubings. In the installation of FIG. 3, the distal conduit section 86 is adjacent to, and is longitudinally aligned with the proximal conduit section 84, and its proximal end is disposed within the terminal end of the proximal conduit section, In the installation of FIG. 4, the distal conduit section 86 is adjacent to, and is longitudinally aligned with, the proximal conduit section 84, and its proximal end is disposed spaced from the terminal end of the proximal conduit section.

While particular embodiments of the present invention have been herein described, it is not intended to limit the invention to such disclosures but changes and modifications may be made therein and thereto within the scope of the following claims.

The invention claimed is:

1. An electrical jumper in combination with a producing well comprising an oil field downhole having an electric voltage source, a plurality of interconnected conduit sections including a hollow casing having an electrical connection to said voltage source, and at least one hollow foramenous liner, said conduit sections being interconnected by joints, the bore of said liner being longitudinally aligned with the bore of said casing, said interconnected conduit sections being electrically conductive to provide a path of electrical conductivity extending from said electrical connection along the length of said producing well to said foramenous liner, at least one of said joints being impaired so as to impede the path of electrical conductivity across said impaired joint, said electrical jumper being positioned to bridge said impaired joint to insure full electrical conductivity between first and second interconnected conduit sections on opposite sides of said impaired joint and comprising a first tubing mounted in a first interconnected conduit section, a second tubing mounted in a second interconnected conduit section, said first and second tubings being composed of an electrically conductive material, a plurality of centering devices mounted on each of said first and second tubings, each centering device consisting of a pair of rings surrounding the tubing and an array of bow springs bridging between the rings and biased to bow outwardly from the tubing into contact with the bore of the associated interconnected conduit section, at least the first of said two rings being electrically and mechanically connected to the tubing, and each bow spring of said array having supplemental electrical contacts electrically connected to said electrically connected ring, the second of said two rings being adapted to be displaced longitudinally of the tubing relative to said connected ring, so that the outer diameter of the array of bow springs may expand or contract to maintain said electrical contacts in operative engagement with the bore of the associated interconnected conduit section.

2. An electrical jumper for a producing well according to claim 1, wherein each of said arrays of bowed springs comprises at least three springs spaced circumferentially about said pair of rings.

3. An electrical jumper for a producing well according to claim 2, wherein said bowed springs are equally spaced about said pair of rings.

4. An electrical jumper for a producing well according to claim 1 wherein said bowed springs are electrically conductive to constitute an electrical connection between said supplemental electrical contacts and said electrically connected ring.

5. An electrical jumper for a producing well according to claim 1 including an anchor rigidly mounted in said casing and supporting said tubings in alignment with the longitudinal centerlines of the bores of said casing and said liner.

6. An electrical jumper for a producing well according to claim 5, said anchor having a body and an electrically insulating connector connecting said body to said second tubing, and at least three jaws disposed circumferentially about said body and dimensioned to be displaced radially outward to firmly engage the interior of said casing and rigidly mount said body within said casing.

7. An electrical jumper for a producing well according to claim 1 wherein said interconnected conduit sections are longitudinally aligned at a said impaired joint, said electrical jumper being mounted within said interconnected conduit sections to bridge said impaired joint with the first tubing within one interconnected conduit section and the second tubing within the adjoining interconnected conduit section.

8. An electrical jumper for a producing well according to claim 7 wherein said tubings have a bore which is between 40 and 55% of the bore of the associated interconnected conduit section and are interconnected by a fitting, said fitting and said tubings providing an annular space surrounding said tubings and said fitting, said connecting joint and said fitting allowing flow between the annular spaces surrounding the tubings within the interconnected conduit sections.

9. An electrical jumper in combination with a producing well for extracting fluids from an underground formation, said producing well having an electric voltage source and first and second intercommunicating electrically conductive conduit sections having intercommunicating bores for said fluids, said first and second sections being connected by an impaired joint which impedes the path of electrical conductivity across said impaired joint, said electrical jumper including a first tubing and a second tubing, said first tubing being dimensioned to be inserted into the bore of said first conduit section and said second tubing being dimensioned to be longitudinally aligned within the bore of said second conduit section, said electrical jumper providing an unimpeded electrical path, as well as fluid communication between said first and second conduit sections and comprising centering devices mounted on each of said first and second tubings, each centering device consisting of a pair of rings surrounding the tubing and an array of bowed springs bridging between the rings and biased to bow outwardly from the tubing into contact with the bore of the associated conduit section, the first of said two rings being electrically and mechanically connected to the tubing, and the second of said two rings being adapted to be displaced longitudinally of the tubing relative to said first ring, so that the outer diameter of the array of bow springs may expand or contract to maintain said bowed springs in operative electrical contact with the bore of the associated conduit section.

10. An electrical jumper for a producing well according to claim 9 wherein said tubings have a bore which is between 40 and 55% of the bore of the associated conduit section and are interconnected by a fitting, said fitting and said tubings providing an annular space surrounding said tubings and said fitting, said connecting joint and said fitting allowing flow between the annular spaces surrounding the tubings within the intercommunicating conduit sections.

11. An electrical jumper for a producing well according to claim 9 wherein said tubings have a bore which is between 40 and 55% of the bore of the associated conduit section and are interconnected by a fitting, said fitting and said tubings providing an annular space surrounding said tubings and said fitting, and a pair of annular plugs composed of an elastomeric material resistant to the fluids in said downhole, one of said annular plugs surrounding one of said tubings and engaging the bore of the associated conduit section to block longitudinal flow in said annular space, and the other of said annular plugs surrounding the other of said tubings and engaging the bore of the other of said intercommunicating conduit sections to block longitudinal flow in said annular space, said annular plugs preventing escape of fluid into said annular space surrounding said fitting.

* * * * *